US006168868B1

(12) United States Patent
Hauser et al.

(10) Patent No.: US 6,168,868 B1
(45) Date of Patent: Jan. 2, 2001

(54) PROCESS FOR APPLYING A LEAD-FREE COATING TO UNTREATED METAL SUBSTRATES VIA ELECTRODEPOSITION

(75) Inventors: Brian T. Hauser, Murrysville; Richard F. Karabin, Ruffs Dale; Thor G. Lingenfelter, Evans City, all of PA (US)

(73) Assignee: PPG Industries Ohio, Inc., Cleveland, OH (US)

( * ) Notice: Under 35 U.S.C. 154(b), the term of this patent shall be extended for 0 days.

(21) Appl. No.: 09/309,850

(22) Filed: May 11, 1999

(51) Int. Cl.[7] ..... C23C 28/00; B32B 15/04

(52) U.S. Cl. ..... 428/457; 484/486; 484/491; 148/257; 204/487

(58) Field of Search ..... 204/484, 486, 204/487, 491; 428/457; 148/257

(56) References Cited

U.S. PATENT DOCUMENTS

| | | | | |
|---|---|---|---|---|
| 3,912,548 | | 10/1975 | Faigen | 148/6.15 R |
| 3,966,502 | | 6/1976 | Binns | 148/6 |
| 4,132,572 | | 1/1979 | Parant et al. | 148/6.15 R |
| 5,129,967 | | 7/1992 | Sander et al. | 148/247 |
| 5,209,788 | | 5/1993 | McMillen et al. | 148/247 |
| 5,328,525 | | 7/1994 | Musingo et al. | 148/247 |
| 5,342,456 | | 8/1994 | Dolan | 148/247 |
| 5,344,504 | | 9/1994 | Deck et al. | 148/243 |
| 5,449,415 | | 9/1995 | Dolan | 148/259 |
| 5,584,946 | | 12/1996 | Karmaschek et al. | 148/247 |
| 5,653,823 | | 8/1997 | McMillen et al. | 148/247 |
| 5,662,746 | | 9/1997 | Affinito | 148/247 |
| 5,702,581 | * | 12/1997 | Kerlin et al. | 204/486 |
| 5,759,376 | * | 6/1998 | Teller et al. | 205/50 |
| 5,801,217 | | 9/1998 | Rodzewich et al. | 523/409 |
| 5,804,652 | | 9/1998 | Jones et al. | 525/56 |

FOREIGN PATENT DOCUMENTS

| | | |
|---|---|---|
| 2087352 | 1/1994 | (CA) . |
| 61911 | 10/1982 | (EP) . |
| 57-192741 | 4/1991 | (JP) . |
| WO95/33869 | 12/1995 | (WO) . |
| WO96/27034 | 9/1996 | (WO) . |
| WO97/14822 | 4/1997 | (WO) . |
| 94/5750 | 8/1994 | (ZA) . |

* cited by examiner

*Primary Examiner*—Kathryn Gorgos
*Assistant Examiner*—Christopher M. Keehan
(74) *Attorney, Agent, or Firm*—William J. Uhl

(57) ABSTRACT

An improved process for applying a lead-free coating by electrodeposition to an untreated ferrous metal substrate is provided. The substrate need not be phosphated prior to treatment. The process includes the following steps:

a) contacting the substrate surface with a group IIIB or IVB metal compound in a medium that is essentially free of accelerators needed to form phosphate conversion coatings; followed by b) electrocoating the substrate with a substantially lead-free, curable electrodepositable composition; and c) curing the electrodepositable composition.

The group IIIB or IVB metal compound is preferably a zirconium compound and is typically in an aqueous medium.

The process may further include initial steps of cleaning the substrate with an alkaline cleaner and rinsing with an acidic rinse.

Substrates treated by the process of the present invention demonstrate excellent corrosion resistance.

19 Claims, No Drawings

PROCESS FOR APPLYING A LEAD-FREE COATING TO UNTREATED METAL SUBSTRATES VIA ELECTRODEPOSITION

BACKGROUND OF THE INVENTION

The present invention relates to an improved process for applying a lead-free coating via electrodeposition to a metal substrate, including ferrous substrates such as cold rolled steel and electrogalvanized steel, and to the coated substrates produced by this process.

Pretreating metal substrates with a phosphate conversion coating and chrome-containing rinses has long been conventional for promoting corrosion resistance. To maximize corrosion resistance over steel substrates, cationic electrodeposition compositions are conventionally formulated with lead as either a pigment or a soluble lead salt and are applied over pretreated (phosphated and chrome rinsed) substrates. Disadvantages associated with phosphating include the amount of plant space required for processing due to multiple (usually eleven to twenty-five) stages; high capital cost; and generation of waste streams containing heavy metals, requiring expensive treatment and disposal. Additionally, lead and chromium used in the electrodepositable composition can cause environmental concerns. The lead may be present in the effluent from electrodeposition processes and chromium may be present in the effluent from pretreatment processes, and these metals need to be removed and disposed of safely, which again requires expensive waste treatment processes.

Nickel-free phosphate solutions and chrome-free rinsing compositions demonstrating corrosion resistance comparable to the nickel- and chrome-containing forerunners are now being sought. Likewise, lead-free electrodepositable compositions are being developed.

U.S. Pat. No. 3,966,502 discloses treatment of phosphated metals with zirconium-containing rinse solutions. International Patent publication WO 98/07770 discloses lead-free electrodepositable compositions for use over phosphated metals. Neither reference teaches treatment or coating processes for bare metal substrates; i.e., metals that have not been phosphated.

It would be desirable to provide a process for coating metal substrates, particularly bare ferrous metals, using compositions that overcome the environmental drawbacks of the prior art and which demonstrate excellent corrosion resistance.

SUMMARY OF THE INVENTION

In accordance with the present invention, an improved process for applying a lead-free coating by electrodeposition to an untreated metal substrate is provided. By "untreated" is meant a bare metal surface; i.e., one that has not been phosphated. The process comprises the following steps:

a) contacting the substrate surface with a group IIIB or IVB metal compound in a medium, typically an aqueous medium, that is essentially free of accelerators needed to form phosphate conversion coatings; followed by b) electrocoating the substrate with a substantially lead-free, curable electrodepositable composition; and c) curing the electrodepositable composition.

The process may further include initial steps of cleaning the substrate with an alkaline cleaner and rinsing with an acidic rinse.

DETAILED DESCRIPTION

Other than in the operating examples, or where otherwise indicated, all numbers expressing quantities of ingredients or reaction conditions used in the specification and claims are to be understood as modified in all instances by the term "about".

The process of the present invention is typically used to treat cold rolled steel substrates, but can be used to treat other metal substrates such as galvanized steel and aluminum, which are used in the assembly of automobile bodies along with cold rolled steel. Moreover, the bare metal substrate being treated by the process of the present invention may be a cut edge of a substrate that is otherwise treated and/or coated over the rest of its surface.

The substrate to be coated is usually first cleaned to remove grease, dirt, or other extraneous matter. This is done by employing conventional cleaning procedures and materials. These would include mild or strong alkaline cleaners such as are commercially available and conventionally used in metal pretreatment processes. Examples of alkaline cleaners include Chemkleen 163 and Chemkleen 177, both of which are available from PPG Industries, Pretreatment and Specialty Products. Such cleaners are generally followed and/or preceded by a water rinse.

Following the optional cleaning step, the metal surface is contacted with a group IIIB or IVB metal compound which is in a medium that is essentially free of accelerators needed to form phosphate conversion coatings. Such accelerators include hydroxylamine, sodium nitrite, and other accelerators known in the art. It is believed that because no phosphate crystal structures are to be formed on the metal substrate surface, no acclerators are necessary. The medium may also be substantially free of phosphates, particularly phosphates of other metals such as zinc, iron, and other metals typically used in phosphating pretreatment processes.

The group IIIB or IVB metal compound is typically in an aqueous medium, usually in the form of an aqueous solution or dispersion depending on the solubility of the metal compound being used. The aqueous solution or dispersion of the group IIIB or IVB metal compound may be applied to the metal substrate by known application techniques, such as dipping or immersion, which is preferred, spraying, intermittent spraying, dipping followed by spraying or spraying followed by dipping. Typically, the aqueous solution or dispersion is applied to the metal substrate at solution or dispersion temperatures ranging from ambient to 150° F. (ambient to 65° C.), and preferably at ambient temperatures. The contact time is generally between 10 seconds and five minutes, preferably 30 seconds to 2 minutes when dipping the metal substrate in the aqueous medium or when the aqueous medium is sprayed onto the metal substrate.

The IIIB or IVB transition metals and rare earth metals referred to herein are those elements included in such groups in the CAS Periodic Table of the Elements as is shown, for example, in the *Handbook of Chemistry and Physics,* 63rd Edition (1983).

Preferred group IIIB and IVB transition metal compounds and rare earth metal compounds are compounds of zirconium, titanium, hafnium, yttrium and cerium and mixtures thereof. Typical zirconium compounds may be selected from hexafluorozirconic acid, alkali metal and ammonium salts thereof, ammonium zirconium carbonate, zirconyl nitrate, zirconium carboxylates and zirconium hydroxy carboxylates such as hydrofluorozirconic acid, zirconium acetate, zirconium oxalate, ammonium zirconium glycolate, ammonium zirconium lactate, ammonium zirconium citrate, and mixtures thereof. Hexafluorozirconic acid is preferred. An example of the titanium compound is fluorotitanic acid and its salts. An example of the hafnium compound is hafnium nitrate. An example of the yttrium compound is yttrium nitrate. An example of the cerium compound is cerous nitrate. The group IIIB or IVB metal compound is present in the medium in an amount of 10 to 5000 ppm metal, preferably 100 to 300 ppm metal. The pH of the aqueous medium usually ranges from 2.0 to about 7.0, preferably about 3.5 to 5.5. The pH of the medium may be adjusted using mineral acids such as hydrofluoric acid, fluoroboric acid, phosphoric acid, and the like, including mixtures thereof; organic acids such as lactic acid, acetic acid, citric acid, or mixtures thereof; and water soluble or water dispersible bases such as sodium hydroxide, ammonium hydroxide, ammonia, or amines such as triethylamine, methylethyl amine, diisopropanolamine, or mixtures thereof.

Additionally, the medium may contain a resinous binder. Suitable resins include reaction products of one or more alkanolamines and an epoxy-functional material containing at least two epoxy groups, such as those disclosed in U.S. Pat. No. 5,653,823. Preferably, such resins contain beta hydroxy ester, imide, or sulfide functionality, incorporated by using dimethylolpropionic acid, phthalimide, or mercaptoglycerine as an additional reactant in the preparation of the resin. Alternatively, the reaction product is that of the diglycidyl ether of Bisphenol A (commercially available from Shell Chemical Company as EPON 880), dimethylol propionic acid, and diethanolamine in a 0.6 to 5.0:0.05 to 5.5:1 mole ratio. Other suitable resinous binders include water soluble and water dispersible polyacrylic acids as disclosed in U.S. Pat. Nos. 3,912,548 and 5,328,525; phenol formaldehyde resins as described in U.S. Pat. No. 5,662,746; water soluble polyamides such as those disclosed in WO 95/33869; copolymers of maleic or acrylic acid with allyl ether as described in Canadian patent application 2,087,352; and water soluble and dispersible resins including epoxy resins, aminoplasts, phenol-formaldehyde resins, tannins, and polyvinyl phenols as discussed in U.S. Pat. No. 5,449,415, incorporated herein by reference.

In this embodiment of the invention, the resinous binder is present in the medium in an amount of 0.005% to 30%, preferably 0.5 to 3%, based on the total weight of the ingredients in the medium, and the group IIIB or IVB metal compound is present in an amount of 10 to 5000, preferably 100 to 1000, ppm metal.

The medium may optionally contain other materials such as nonionic surfactants and auxiliaries conventionally used in the art of pretreatment. In an aqueous medium, water dispersible organic solvents, for example, alcohols with up to about 8 carbon atoms such as methanol, isopropanol, and the like, may be present; or glycol ethers such as the monoalkyl ethers of ethylene glycol, diethylene glycol, or propylene glycol, and the like. When present, water dispersible organic solvents are typically used in amounts up to about ten percent by volume, based on the total volume of aqueous medium.

Other optional materials include surfactants that function as defoamers or substrate wetting agents. Anionic, cationic, amphoteric, or nonionic surfactants may be used. Compatible mixtures of such materials are also suitable. Defoaming surfactants are typically present at levels up to about 1 percent, preferably up to about 0.1 percent by volume, and wetting agents are typically present at levels up to about 2 percent, preferably up to about 0.5 percent by volume, based on the total volume of medium.

The film coverage of the residue of the pretreatment coating composition generally ranges from about 1 to about 1000 milligrams per square meter ($mg/m^2$), and is preferably about 10 to about 400 $mg/m^2$.

The thickness of the pretreatment coating can vary, but is generally less than about 1 micrometer, preferably ranges from about 1 to about 500 nanometers, and more preferably is about 10 to about 300 nanometers.

Other optional steps may be included in the process of the present invention. For example, the metal surface may be rinsed with an aqueous acidic solution after cleaning with the alkaline cleaner and before contact with the group IIIB or IVB metal compound. Examples of rinse solutions include mild or strong acidic cleaners such as the dilute nitric acid solutions commercially available and conventionally used in metal pretreatment processes.

After contact with the group IIIB or IVB metal compound the substrate may be rinsed with water and electrocoated directly; i.e., without a phosphating step as is conventional in the art. Electrocoating may be done immediately or after a drying period at ambient or elevated temperature conditions. The electrocoating step is done with a substantially lead-free, curable, electrodepositable composition and is followed by a curing step.

In the process of electrodeposition, the metal substrate being treated, serving as an electrode, and an electrically conductive counter electrode are placed in contact with an ionic, electrodepositable composition. Upon passage of an electric current between the electrode and counter electrode while they are in contact with the electrodepositable composition, an adherent film of the electrodepositable composition will deposit in a substantially continuous manner on the metal substrate.

Electrodeposition is usually carried out at a constant voltage in the range of from about 1 volt to several thousand volts, typically between 50 and 500 volts. Current density is usually between about 1.0 ampere and 15 amperes per square foot (10.8 to 161.5 amperes per square meter) and tends to decrease quickly during the electrodeposition process, indicating formation of a continuous self-insulating film.

After electrodeposition, the coating is heated to cure the deposited composition. The heating or curing operation is usually carried out at a temperature in the range of from 120 to 250° C., preferably from 120 to 190° C. for a period of time ranging from 10 to 60 minutes. The thickness of the resultant film is usually from about 10 to 50 microns.

Preferably in the electrocoating step, the metal substrate being treated serves as a cathode, and the electrodepositable composition is cationic.

In a preferred embodiment of the invention, the substantially lead-free, curable cationic electrodepositable composition contains an amine salt group-containing resin derived from a polyepoxide. The resin is used in combination with a polyisocyanate curing agent that is at least partially capped with a capping agent.

In a particularly preferred embodiment, the cationic resin is derived from a polyepoxide, which may be chain extended by reacting together a polyepoxide and a polyhydroxyl group-containing material selected from alcoholic hydroxyl group-containing materials and phenolic hydroxyl group-containing materials to chain extend or build the molecular weight of the polyepoxide. The resin contains cationic salt groups and active hydrogen groups selected from aliphatic hydroxyl and primary and secondary amino.

A chain extended polyepoxide is typically prepared by reacting together the polyepoxide and polyhydroxyl group-containing material neat or in the presence of an inert organic solvent such as a ketone, including methyl isobutyl ketone and methyl amyl ketone, aromatics such as toluene and xylene, and glycol ethers such as the dimethyl ether of diethylene glycol. The reaction is usually conducted at a temperature of about 80° C. to 160° C. for about 30 to 180 minutes until an epoxy group-containing resinous reaction product is obtained.

The equivalent ratio of reactants; i.e., epoxy:polyhydroxyl group-containing material is typically from about 1.00:0.75 to 1.00:2.00.

The polyepoxide preferably has at least two 1,2-epoxy groups. In general the epoxide equivalent weight of the polyepoxide will range from 100 to about 2000, typically from about 180 to 500. The epoxy compounds may be saturated or unsaturated, cyclic or acyclic, aliphatic, alicyclic, aromatic or heterocyclic. They may contain substituents such as halogen, hydroxyl, and ether groups.

Examples of polyepoxides are those having a 1,2-epoxy equivalency greater than one and preferably about two; that is, polyepoxides which have on average two epoxide groups per molecule. The preferred polyepoxides are polyglycidyl ethers of cyclic polyols. Particularly preferred are polyglycidyl ethers of polyhydric phenols such as Bisphenol A. These polyepoxides can be produced by etherification of polyhydric phenols with an epihalohydrin or dihalohydrin such as epichlorohydrin or dichlorohydrin in the presence of alkali. Besides polyhydric phenols, other cyclic polyols can be used in preparing the polyglycidyl ethers of cyclic polyols. Examples of other cyclic polyols include alicyclic polyols, particularly cycloaliphatic polyols such as 1,2-cyclohexane diol and 1,2-bis(hydroxymethyl)cyclohexane. The preferred polyepoxides have molecular weights ranging from about 180 to 500, preferably from about 186 to 350. Epoxy group-containing acrylic polymers can also be used, but they are not preferred.

Examples of polyhydroxyl group-containing materials used to chain extend or increase the molecular weight of the polyepoxide (i.e., through hydroxyl-epoxy reaction) include alcoholic hydroxyl group-containing materials and phenolic hydroxyl group-containing materials. Examples of alcoholic hydroxyl group-containing materials are simple polyols such as neopentyl glycol; polyester polyols such as those described in U.S. Pat. No. 4,148,772, incorporated herein by reference; polyether polyols such as those described in U.S. Pat. No. 4,468,307, incorporated herein by reference; and urethane diols such as those described in U.S. Pat. No. 4,931,157, incorporated herein by reference. Examples of phenolic hydroxyl group-containing materials are polyhydric phenols such as Bisphenol A, phloroglucinol, catechol, and resorcinol. Mixtures of alcoholic hydroxyl group-containing materials and phenolic hydroxyl group-containing materials may also be used. Bisphenol A is preferred.

The polyepoxide also contains cationic salt groups. The cationic salt groups are preferably incorporated into the resin by reacting the epoxy group-containing resinous reaction product prepared as described above with a cationic salt group former. By "cationic salt group former" is meant a material which is reactive with epoxy groups and which can be acidified before, during, or after reaction with the epoxy groups to form cationic salt groups. Examples of suitable materials include amines such as primary or secondary amines which can be acidified after reaction with the epoxy groups to form amine salt groups, or tertiary amines which can be acidified prior to reaction with the epoxy groups and which after reaction with the epoxy groups form quaternary ammonium salt groups. Examples of other cationic salt group formers are sulfides which can be mixed with acid prior to reaction with the epoxy groups and form ternary sulfonium salt groups upon subsequent reaction with the epoxy groups.

When amines are used as the cationic salt formers, monoamines are preferred, and hydroxyl-containing amines are particularly preferred. Polyamines may be used but are not recommended because of a tendency to gel the resin.

Tertiary and secondary amines are preferred to primary amines because primary amines are polyfunctional with respect to epoxy groups and have a greater tendency to gel the reaction mixture. If polyamines or primary amines are used, they should be used in a substantial stoichiometric excess to the epoxy functionality in the polyepoxide so as to prevent gelation and the excess amine should be removed from the reaction mixture by vacuum stripping or other technique at the end of the reaction. The epoxy may be added to the amine to ensure excess amine.

Examples of hydroxyl-containing amines are alkanolamines, dialkanolamines, trialkanolamines, alkyl alkanolamines, and aralkyl alkanolamines containing from 1 to 18 carbon atoms, preferably 1 to 6 carbon atoms in each of the alkanol, alkyl and aryl groups. Specific examples include ethanolamine, N-methylethanolamine, diethanolamine, N-phenylethanolamine, N,N-dimethylethanolamine, N-methyldiethanolamine, triethanolamine and N-(2-hydroxyethyl)-piperazine.

Amines such as mono, di, and trialkylamines and mixed aryl-alkyl amines which do not contain hydroxyl groups or amines substituted with groups other than hydroxyl which do not negatively affect the reaction between the amine and the epoxy may also be used. Specific examples include ethylamine, methylethylamine, triethylamine, N-benzyldimethylamine, dicocoamine and N,N-dimethylcyclohexylamine.

Mixtures of the above mentioned amines may also be used.

The reaction of a primary and/or secondary amine with the polyepoxide takes place upon mixing of the amine and polyepoxide. The amine may be added to the polyepoxide or vice versa. The reaction can be conducted neat or in the presence of a suitable solvent such as methyl isobutyl ketone, xylene, or 1-methoxy-2-propanol. The reaction is generally exothermic and cooling may be desired. However, heating to a moderate temperature of about 50 to 150° C. may be done to hasten the reaction.

The reaction product of the primary and/or secondary amine and the polyepoxide is made cationic and water dispersible by at least partial neutralization with an acid. Suitable acids include organic and inorganic acids such as formic acid, acetic acid, lactic acid, phosphoric acid and sulfamic acid. Sulfamic acid is preferred. The extent of neutralization varies with the particular reaction product involved. However, sufficient acid should be used to disperse the electrodepositable composition in water. Typically, the amount of acid used provides at least 20 percent of all of the total neutralization. Excess acid may also be used beyond the amount required for 100 percent total neutralization.

In the reaction of a tertiary amine with a polyepoxide, the tertiary amine can be prereacted with the neutralizing acid to form the amine salt and then the amine salt reacted with the polyepoxide to form a quaternary salt group-containing resin. The reaction is conducted by mixing the amine salt with the polyepoxide in water. Typically the water is present in an amount ranging from about 1.75 to about 20 percent by weight based on total reaction mixture solids.

In forming the quaternary ammonium salt group-containing resin, the reaction temperature can be varied from the lowest temperature at which the reaction will proceed, generally room temperature or slightly thereabove, to a maximum temperature of about 100° C. (at atmospheric pressure). At higher pressures, higher reaction temperatures may be used. Preferably the reaction temperature is in the range of about 60 to 100° C. Solvents such as a sterically hindered ester, ether, or sterically hindered ketone may be used, but their use is not necessary.

In addition to the primary, secondary, and tertiary amines disclosed above, a portion of the amine that is reacted with the polyepoxide can be a ketimine of a polyamine, such as is described in U.S. Pat. No. 4,104,147, column 6, line 23 to column 7, line 23, incorporated herein by reference. The ketimine groups decompose upon dispersing the amine-epoxy resin reaction product in water.

In addition to resins containing amine salts and quaternary ammonium salt groups, cationic resins containing ternary sulfonium groups may be used in forming the cationic polyepoxide. Examples of these resins and their method of preparation are described in U.S. Pat. Nos. 3,793,278 to DeBona and 3,959,106 to Bosso et al., incorporated herein by reference.

The extent of cationic salt group formation should be such that when the resin is mixed with an aqueous medium and the other ingredients, a stable dispersion of the electrodepositable composition will form. By "stable dispersion" is meant one that does not settle or is easily redispersible if some settling occurs. Moreover, the dispersion should be of sufficient cationic character that the dispersed particles will migrate toward and electrodeposit on a cathode when an electrical potential is set up between an anode and a cathode immersed in the aqueous dispersion.

Generally, the cationic resin is non-gelled and contains from about 0.1 to 3.0, preferably from about 0.1 to 0.7 millequivalents of cationic salt group per gram of resin solids. The number average molecular weight of the cationic polyepoxide preferably ranges from about 2,000 to about 15,000, more preferably from about 5,000 to about 10,000. By "non-gelled" is meant that the resin is substantially free from crosslinking, and prior to cationic salt group formation, the resin has a measurable intrinsic viscosity when dissolved in a suitable solvent. In contrast, a gelled resin, having an essentially infinite molecular weight, would have an intrinsic viscosity too high to measure.

The active hydrogens associated with the cationic polyepoxide include any active hydrogens which are reactive with isocyanates within the temperature range of about 93 to 204° C., preferably about 121 to 177° C. Typically, the active hydrogens are selected from the group consisting of hydroxyl and primary and secondary amino, including mixed groups such as hydroxyl and primary amino. Preferably, the polyepoxide will have an active hydrogen content of about 1.7 to 10 millequivalents, more preferably about 2.0 to 5 millequivalents of active hydrogen per gram of resin solids.

Beta-hydroxy ester groups may be incorporated into the polyepoxide by ring opening 1,2-epoxide groups of the polyepoxide with a material which contains at least one carboxylic acid group. The carboxylic acid functional material may be a monobasic acid such as dimethylolpropionic acid, malic acid, and 12-hydroxystearic acid; a polybasic acid such as a simple dibasic acid or the half ester reaction products of a polyol and the anhydride of a diacid, or a combination thereof. If a monobasic acid is used, it preferably has hydroxyl functionality associated with it. Suitable polybasic acids include succinic acid, adipic acid, citric acid, and trimellitic acid. If a polybasic acid is used, care must be taken to prevent gelation of the reaction mixture by limiting the amount of polybasic acid and/or by additionally reacting a monobasic acid. Suitable half ester reaction products include, for example, the reaction product of trimethylolpropane and succinic anhydride at a 1:1 equivalent ratio. Suitable hydroxyl group-containing carboxylic acids include dimethylolpropionic acid, malic acid, and 12-hydroxystearic acid. Dimethylolpropionic acid is preferred.

Phenolic hydroxyl groups may be incorporated into the polyepoxide by using a stoichiometric excess of the polyhydric phenol during initial chain extension of the polyepoxide. Although a stoichiometric excess of phenolic hydroxyl groups to epoxy is used, there still remains unreacted epoxy groups in the resulting resinous reaction product for subsequent reaction with the cationic salt group former. It is believed that a portion of polyhydric phenol remains unreacted.

When the polyepoxide contains both phenolic hydroxyl groups and beta-hydroxy ester groups, the phenolic hydroxyl groups may be incorporated simultaneously with the beta-hydroxy ester groups, or sequentially before or after. Preferably, however, the phenolic hydroxyl groups are incorporated into the polyepoxide after incorporation of the beta-hydroxy ester groups by reacting a stoichiometric excess of polyhydric phenol with the resulting polyepoxide. Once again, despite the stoichiometric excess of phenolic hydroxyl groups to epoxy being used, unreacted epoxy groups remain in the resulting resinous reaction product for subsequent reaction with the cationic salt group former.

In this particularly preferred embodiment, the polyisocyanate curing agent is a fully capped polyisocyanate with substantially no free isocyanate groups. The polyisocyanate can be an aliphatic or an aromatic polyisocyanate or a mixture of the two. Diisocyanates are preferred, although higher polyisocyanates can be used in place of or in combination with diisocyanates.

Examples of suitable aliphatic diisocyanates are straight chain aliphatic diisocyanates such as 1,4-tetramethylene diisocyanate and 1,6-hexamethylene diisocyanate. Also, cycloaliphatic diisocyanates can be employed. Examples include isophorone diisocyanate and 4,4'-methylene-bis-(cyclohexyl isocyanate). Examples of suitable aromatic diisocyanates are p-phenylene diisocyanate, diphenylmethane-4,4'-diisocyanate and 2,4- or 2,6-toluene diisocyanate. Examples of suitable higher polyisocyanates are triphenylmethane-4,4',4"-triisocyanate, 1,2,4-benzene triisocyanate and polymethylene polyphenyl isocyanate.

Isocyanate prepolymers, for example, reaction products of polyisocyanates with polyols such as neopentyl glycol and trimethylol propane or with polymeric polyols such as polycaprolactone diols and triols (NCO/OH equivalent ratio greater than one) can also be used. A mixture of diphenylmethane-4,4'-diisocyanate and polymethylene polyphenyl isocyanate is preferred.

Any suitable aliphatic, cycloaliphatic, or aromatic alkyl monoalcohol or phenolic compound may be used as a capping agent for the polyisocyanate including, for example, lower aliphatic alcohols such as methanol, ethanol, and n-butanol; cycloaliphatic alcohols such as cyclohexanol; aromatic-alkyl alcohols such as phenyl carbinol and methylphenyl carbinol; and phenolic compounds such as phenol itself and substituted phenols wherein the substituents do not affect coating operations, such as cresol and nitrophenol. Glycol ethers may also be used as capping agents. Suitable glycol ethers include ethylene glycol butyl ether, diethylene glycol butyl ether, ethylene glycol methyl ether and propylene glycol methyl ether. Diethylene glycol butyl ether is preferred among the glycol ethers.

Other suitable capping agents include oximes such as methyl ethyl ketoxime, acetone oxime and cyclohexanone oxime, lactams such as epsilon-caprolactam, and amines such as dibutyl amine.

Beta-hydroxy ester groups may be incorporated into the polyisocyanate by reacting the isocyanate groups of the polyisocyanate with the hydroxyl group of a hydroxyl group-containing carboxylic acid such as dimethylolpropionic acid, malic acid, and 12-hydroxystearic acid. Dimethylolpropionic acid is preferred. The acid group on the hydroxyl group-containing carboxylic acid is reacted (either before or after reaction of the isocyanate group with the hydroxyl group) with an epoxy functional material such as a monoepoxide or polyepoxide, ring opening a 1,2-epoxide group on the epoxy functional material to form the beta-hydroxy ester group. Examples of monoepoxides which may be used include ethylene oxide, propylene oxide, 1,2-butylene oxide, 1,2-pentene oxide, styrene oxide, and glycidol. Other examples of monoepoxides include glycidyl esters of monobasic acids such as glycidyl acrylate, glycidyl methacrylate, glycidyl acetate, glycidyl butyrate; linseed glycidyl ester and glycidyl ethers of alcohols and phenols such as butyl glycidyl ether and phenylglycidyl ether.

Examples of polyepoxides which may be used to form the beta-hydroxy ester groups in the polyisocyanate are those having a 1,2-epoxy equivalency greater than one and preferably about two; that is, polyepoxides which have on average two epoxide groups per molecule. The preferred polyepoxides are polyglycidyl ethers of cyclic polyols. Particularly preferred are polyglycidyl ethers of polyhydric phenols such as Bisphenol A.

Phenolic hydroxyl groups may be incorporated into the polyisocyanate by capping the isocyanate groups with phenolic materials having an aliphatic and a phenolic hydroxyl group such as 2-hydroxybenzyl alcohol. The isocyanate group will react preferentially with the aliphatic hydroxyl group. It is also possible to incorporate phenolic hydroxyl groups into the polyisocyanate by capping the isocyanate groups with a hydroxyl functional polyepoxide such as a polyglycidyl ether of a cyclic polyol or polyhydric phenol, which is further reacted with a stoichiometric excess of a polyhydric phenol.

These electrodepositable compositions may further include additional ingredients having beta-hydroxy ester and/or phenolic hydroxyl groups, as well as customary auxiliaries typically used in electrodepositable compositions. Such electrodepositable compositions are described in WO 98/07770.

Untreated metal substrates coated by the process of the present invention demonstrate excellent corrosion resistance as determined by salt spray corrosion resistance testing. The excellent corrosion resistance is unexpected since the phosphating step has been eliminated, and results are comparable to corrosion resistance obtainable with lead-containing electrodepositable compositions.

The invention will be further described by reference to the following examples. Unless otherwise indicated, all parts are by weight.

EXAMPLES

In accordance with the present invention, the following examples show the preparation of various zirconium-containing aqueous pretreatments, their application to bare ferrous and galvanized substrates, and comparative corrosion testing results.

Preparation of Panels for Corrosion Testing

Bare, or untreated cold rolled steel and electrogalvanized substrates used in preparing test panels were purchased from ACT Laboratories, Inc., Hillsdale, Mich. The panels treated in the examples that follow have all been pretreated in the following process sequence unless otherwise noted in the example. The term "ambient temperature" in the subsequent examples describes conditions at about 20–30° C. All pretreatment compositions were adjusted to the pH indicated in the tables below with 10% ammonium hydroxide or 1% sulfamic acid, and measured at ambient temperatures using a Digital Ionalyzer Model SA720, commercially available from Orion Research.

General panel preparation sequence:

Stage #1 "CHEMKLEEN 163", an alkaline cleaner available from PPG Industries, Inc. sprayed @ 2% by volume at 0–65° C. for 1–2 minutes.

Stage #2 Tap water immersion rinse 15–30 seconds, ambient temperature.

Stage #3 Immersion in non-phosphate containing aqueous pretreatment solution, 60 seconds, ambient temperature.

Stage #4 Deionized water immersion rinse, 15–30 seconds, ambient temperature.

Optionally, an immersion in a 2% by volume nitric acid solution for 5–15 seconds followed by a tap water rinse can be done following stage #2 and before stage #3. Following stage #4, an optional drying with warm air can be done before electrodeposition of the leaded or lead-free composition. The leaded composition was ED 5650 available from PPG Industries, Inc. The unleaded composition was similar to ED 5650 but with the lead removed.

Panels prepared by the above procedure produce very thin films on the order of 7–10 nm as determined by depth profiling X-ray photoelectron spectroscopy and profilometry.

Panels were electrocoated with the lead containing or lead-free electrodepositable coatings. After curing of the electrodepositable paint, panels were scribed with either a large X for testing in salt spray (per ASTM B117) or warm salt water immersion (5% NaCl solution in deionized water maintained at 55° C.), or a straight vertical line for cyclic corrosion testing (per General Motors 9540P, 'Cycle B'). After testing was complete (lengths for each test protocol detailed in the tables below), panels were grit blasted to remove corrosion products and delaminated paint. Panels were evaluated by measuring the total creepback of the paint from each side of the scribe at two points where paint loss was at the minimum and maximum. Data is reported in the tables as a range in millimeters.

The compositions of the various zirconium-containing pretreatments that were tested are listed in Table I. All compositions were prepared by adding the appropriate amount of material listed in the table to a portion of deionized water with stirring. Enough deionized water was then added to bulk the solution to one liter. The pH of the pretreatment solutions was then adjusted to the value in the table by dropwise addition of 10% ammonium hydroxide if the initial pH was <4.5, and 1% sulfamic acid if the initial pH was >4.5.

TABLE I

Composition of Pretreatment Examples 2–9

| Component | Example #, Level in ppm | | | | | | | |
|---|---|---|---|---|---|---|---|---|
| | 2 | 3 | 4 | 5 | 6 | 7 | 8 | 9 |
| Fluorozirconic Acid[1] | 398 | 398 | | | | | | 398 |
| Reaction product of EPON 880/DMPA/DEA[2] | | 1000 | | | | | | |
| Ammonium Zr Carbonate[3] | | | 2947 | 2947 | | | | |
| Zirconyl Nitrate[4] | | | | | 444 | 444 | | |
| Ammonium Zr Citrate[4] | | | | | | | 675 | |
| Chemseal 77[5] | | | | | | | | 1000 |
| pH | 4.5 | 4.5 | 8.6 | 5.5 | 5.5 | 4.4 | 5.8 | 4.6 |

[1]available from Riedel de Haën as a 45% aqueous solution
[2]reacted in a 10/3.5/2.5 mole ratio and dispersed to 70% total neutralization in sulfamic acid
[3]available from Magnesium Elektron, Inc. as a 20% solution
[4]available from Aldrich Chemical Company
[5]conventional non-chrome post-rinse for phosphated substrates available from PPG Pretreatment and Specialty Chemicals, compositions disclosed in U.S. Pat. No. 5,653,823

Note that panels of Example 1 underwent only stages 1 and 2 of the above procedure; i.e., no immersion in non-phosphate containing aqueous pretreatment solution took place.

Corrosion Results from Salt Spray Testing

The corrosion resistance produced by pretreatment compositions listed in Table I was measured according to ASTM B117, entitled "Standard Test Method of Salt Spray (Fog) Testing." Panels prepared as in Example 1 were painted with either a lead-containing (comparative) available from PPG Industries, Inc. as ED 5650 or a lead-free electrodepositable composition similar to the lead-containing electrocoat but without the lead to determine the strength of each variation as a new pretreatment for lead-free electrodepositable paint relative to lead-containing compositions.

TABLE II

Salt Spray Test (ASTM B117) 600 hrs

| Bath Example # | ED Type | Scribe Creep (mm) | |
|---|---|---|---|
| | | Bare CRS | Bare EG |
| 1 (Alkaline clean only) | Leaded | 5–8 | 2–15 |
| | Lead-free | 12–17 | 7–17 |
| 2 | Leaded | 2–4 | 3–13 |
| | Lead-free | 2–3 | 1–10 |
| 3 | Leaded | 2–3 | 4–12 |
| | Lead-free | 4–5 | 1–15 |
| 4 | Leaded | 8–10 | |
| | Lead-free | 14–17 | |
| 5 | Leaded | 7–10 | |
| | Lead-free | 14–16 | |
| 6 | Leaded | 7–9 | |
| | Lead-free | 13–15 | |
| 7 | Leaded | 6–8 | |
| | Lead-free | 12–16 | |

TABLE II-continued

Salt Spray Test (ASTM B117) 600 hrs

| Bath Example # | ED Type | Scribe Creep (mm) | |
|---|---|---|---|
| | | Bare CRS | Bare EG |
| 8 | Leaded | 7–9 | |
| | Lead-free | 15–17 | |
| 9 | Leaded | 10–13 | |
| | Lead-free | 18–20 | |

The data in Table II illustrate that the corrosion performance on cold rolled steel of the lead-free electrocoat paint is as good as the lead-containing paint when pretreated with the composition detailed in Example #2. Furthermore, the data indicates that when using the composition in Example #2 on electrogalvanized steel, the performance with lead-free electrocoat exceeds the performance with the leaded version.

Corrosion Results from Warm Salt Water Immersion

Bare cold rolled steel and electrogalvanized panels were treated with solutions from Table I via the procedure stages listed above and tested for corrosion resistance using the warm salt water immersion test, which is an immersion in a 5% NaCl solution deionized water maintained at 55° C. Panels were described above. Results are summarized in Table III below.

TABLE III

Warm Salt Water Immersion (20 days)

| Bath Example # | ED Type | Scribe Creep (mm) | |
|---|---|---|---|
| | | Bare CRS | Bare EG |
| 1 (Alkaline clean only) | Leaded | 24–26 | 5–16 |
| | Lead-free | TD[6] | 8–14 |
| 2 | Leaded | 12–19 | 3–9 |
| | Lead-free | 18–20 | 5–9 |
| 3 | Leaded | 15–18 | 4–7 |
| | Lead-free | 17–18 | 3–12 |
| 4 | Leaded | 14–19 | |
| | Lead-free | >35 | |
| 5 | Leaded | 14–15 | |
| | Lead-free | >35 | |
| 6 | Leaded | 15–18 | |
| | Lead-free | >35 | |
| 7 | Leaded | 17–19 | |
| | Lead-free | >35 | |
| 8 | Leaded | 13–16 | |
| | Lead-free | 30–32 | |
| 9 | Leaded | 16–19 | |
| | Lead-free | TD | |

[6]Total Delamination of paint from substrate

The data reflects the greater severity of this test as reflected in the higher scribe creep ranges. However, a noticeable improvement relative to the clean only control, is again observed on both substrates using the pretreatment described in Example #2.

Corrosion Results from Cycle B Testing

Bare cold rolled steel and electrogalvanized panels were treated with solutions from Table I and tested for corrosion performance using the Cycle B cyclic corrosion test as per General Motors Test Method 9540P. Panels prepared from bath compositions in Table I were prepared and painted as in the examples above. Results are summarized in Table IV below.

TABLE IV

Cycle B Corrosion Results on Cold Rolled Steel (30 cycles)

| Bath Example # | ED Type | Scribe creep |
|---|---|---|
| 1 (Alkaline clean only) | Leaded | 5–6 |
| | Lead-free | TD |
| 2 | Leaded | 4–5 |
| | Lead-free | 3–4 |
| 3 | Leaded | 4–5 |
| | Lead-free | 4–5 |
| 4 | Leaded | 4–5 |
| | Lead-free | 6–7 |
| 5 | Leaded | 4–5 |
| | Lead-free | 7–9 |
| 6 | Leaded | 4–5 |
| | Lead-free | 7–9 |
| 7 | Leaded | 5–6 |
| | Lead-free | 6–7 |
| 8 | Leaded | 4–5 |
| | Lead-free | 7–9 |
| 9 | Leaded | 4–5 |
| | Lead-free | 7–9 |

[6]Total Delamination of paint from substrate

From the data in Tables II–IV, it is apparent that corrosion performance of a lead-free electrodepositable coating can be dramatically improved to equal the performance of a lead-containing electrocoat on non-phosphated cold rolled steel and electrogalvanized steel by pretreatment with the preferred composition described in Example 2 of Table I. This is particular important in using a lead-free electrodepositable coating for painting automobile frames. These frames have hidden or recessed inner parts, frequently made of cold rolled steel which are often poorly phosphated and therefore have traditionally not met corrosion requirements with lead-free coatings.

We claim:

1. A process for applying a lead-free coating by electrodeposition to an untreated ferrous metal substrate comprising the following steps:

(a) contacting the untreated substrate surface with a group IIIB or IVB metal compound in a medium that is essentially free of accelerators needed to form phosphate conversion coatings; followed by (b) electrocoating the substrate which serves as an electrode in an electrical circuit comprising said electrode and a counter electrode immersed in an aqueous, substantially lead-free curable electrodepositable composition containing an ionic water dispersible resin; and (c) heating the electrodeposited film to cure the film.

2. The process of claim 1 further comprising the step of cleaning the metal surface with an alkaline cleaner before contact with the group IIIB or IVB metal compound.

3. The process of claim 2 further comprising the step of rinsing the metal surface with an aqueous acidic solution after cleaning with the alkaline cleaner and before contact with the group IIIB or IVB metal compound.

4. The process of claim 1 wherein the Group IIIB or IVB metal compound is present in an aqueous medium.

5. The process of claim 4 wherein the substrate is contacted with the Group IIIB or IVB metal compound in the aqueous medium at a temperature of about 68° F. to 150° F., (20° C. to 65° C.).

6. The process of claim 4 wherein the substrate is contacted with the Group IIIB or IVB metal compound by immersion.

7. The process of claim 1 wherein the Group IIIB or IVB metal compound is a zirconium compound.

8. The process of claim 7 wherein the zirconium compound is hexafluorozirconic acid.

9. The process of claim 1 wherein the ionic water dispersible resin is a cationic resin.

10. The process of claim 9 wherein the cationic water dispersible resin contains amine salt groups and is derived from a polyepoxide.

11. The process of claim 10 wherein the electrodepositable composition further comprises a polyisocyanate curing agent that is at least partially capped with a capping agent.

12. The process of claim 7 wherein the zirconium compound is present in the aqueous medium in an amount of 10 to 5000 ppm Zr.

13. The process of claim 1 wherein the metal substrate is cold rolled steel.

14. The process of claim 1 wherein the metal substrate is zinc coated steel.

15. A substrate coated in accordance with the process of claim 1.

16. A process for applying a lead-free coating by electrodeposition to an untreated ferrous metal substrate comprising the following steps:

(a) contacting the untreated substrate surface with a group IIIB or IVB metal compound in a medium that is substantially free of phosphates; followed by (b) electrocoating the substrate which serves as an electrode in an electrical circuit comprising said electrode and a counter electrode immersed in an aqueous, substantially lead-free curable electrodepositable composition containing an ionic water dispersible resin; and (c) heating the electrodeposited film to cure the film.

17. The process of claim 16 wherein the group IIIB or IVB metal compound is a zirconium compound.

18. The process of claim 16 wherein the metal substrate is a cold rolled steel.

19. The process of claim 16 wherein the metal substrate is a zinc coated steel.

* * * * *

US006168868C1

(12) EX PARTE REEXAMINATION CERTIFICATE (4931st)

United States Patent

Hauser et al.

(10) Number: US 6,168,868 C1

(45) Certificate Issued: Apr. 27, 2004

(54) PROCESS FOR APPLYING A LEAD-FREE COATING TO UNTREATED METAL SUBSTRATES VIA ELECTRODEPOSITION

(75) Inventors: Brian T. Hauser, Murrysville, PA (US); Richard F. Karabin, Ruffs Dale, PA (US); Thor G. Lingenfelter, Evans City, PA (US)

(73) Assignee: PPG Industries Ohio, Inc., Cleveland, OH (US)

Reexamination Request:
No. 90/005,915, Jan. 25, 2001

Reexamination Certificate for:

| | |
|---|---|
| Patent No.: | **6,168,868** |
| Issued: | **Jan. 2, 2001** |
| Appl. No.: | **09/309,850** |
| Filed: | **May 11, 1999** |

(51) Int. Cl.[7] ..... C23C 28/00; B32B 15/04

(52) U.S. Cl. ..... 428/457; 484/486; 484/491; 148/257; 204/487

(56) References Cited

U.S. PATENT DOCUMENTS 4,457,790 A * 7/1984 Lindert et al. ..... 106/6.15 R
5,587,059 A * 12/1996 Yamamoto et al. ..... 204/505
5,702,581 A * 12/1997 Kerlin et al. ..... 204/485
5,851,371 A * 12/1998 Steinbrecher et al. ..... 204/486

* cited by examiner

*Primary Examiner*—Kishor Mayekar

(57) ABSTRACT

An improved process for applying a lead-free coating by electrodeposition to an untreated ferrous metal substrate is provided. The substrate need not be phosphated prior to treatment. The process includes the following steps:

a) contacting the substrate surface with a group IIIB or IVB metal compound in a medium that is essentially free of accelerators needed to form phosphate conversion coatings; followed by b) electrocoating the substrate with a substantially lead-free, curable electrodepositable composition; and c) curing the electrodepositable composition.

The group IIIB or IVB metal compound is preferably a zirconium compound and is typically in an aqueous medium.

The process may further include initial steps of cleaning the substrate with an alkaline cleaner and rinsing with an acidic rinse.

Substrates treated by the process of the present invention demonstrate excellent corrosion resistance.

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–19 are cancelled.

* * * * *